United States Patent [19]

Cowen

[11] Patent Number: 5,035,050

[45] Date of Patent: Jul. 30, 1991

[54] METHOD OF INSTALLING A VALVE ASSEMBLY IN A COMPRESSOR

[75] Inventor: Russell A. Cowen, Brooklyn, Mich.

[73] Assignee: Tecumseh Products Company, Tecumseh, Mich.

[21] Appl. No.: 545,278

[22] Filed: Jun. 28, 1990

Related U.S. Application Data

[62] Division of Ser. No. 311,108, Feb. 15, 1989, Pat. No. 4,955,797.

[51] Int. Cl.[5] ..... F04B 39/10

[52] U.S. Cl. ..... 29/888.02; 29/428; 29/525.2; 418/15

[58] Field of Search ..... 29/888.02, 525.1, 525.2, 29/428; 418/15, 270, 63, 179; 137/855, 856, 857, 858

[56] References Cited

U.S. PATENT DOCUMENTS

| | | | |
|---|---|---|---|
| 1,342,216 | 6/1920 | Henig . | |
| 2,151,746 | 3/1939 | Cody . | |
| 2,859,912 | 11/1958 | Swart et al. . | |
| 2,908,287 | 9/1957 | Augustin . | |
| 3,370,786 | 2/1968 | Brown . | |
| 3,400,885 | 9/1968 | Enemark et al. . | |
| 3,911,546 | 10/1975 | Schrock et al. . | |
| 3,998,571 | 12/1976 | Falke . | |
| 4,532,685 | 8/1985 | Itoh et al. | 29/888.02 |
| 4,550,645 | 11/1985 | Beck, Jr. | 29/888.02 |
| 4,580,604 | 4/1986 | Kawaguchi et al. . | |
| 4,629,403 | 12/1986 | Wood . | |
| 4,642,037 | 2/1987 | Fritchman . | |
| 4,730,996 | 3/1988 | Akatsuchi et al. | 418/ |
| 4,764,099 | 8/1988 | Nakajima et al. | 29/888.02 |

FOREIGN PATENT DOCUMENTS

| | | |
|---|---|---|
| 60-22087 | 2/1985 | Japan . |
| 63-3248994 | 10/1988 | Japan . |

*Primary Examiner*—Irene Cuda

*Attorney, Agent, or Firm*—Jeffers, Hoffman & Niewyk

[57] ABSTRACT

A discharge valve assembly, comprising a reed valve and an overlying valve retainer, is cantilever mounted on the axially outer surfaces of cast iron main and outboard bearings of a rotary vane compressor. Each valve assembly includes a round mounting end having an off-center hole extending through the valve and retainer, and an opposite end associated with opening and closing a discharge port extending through the bearing. The mounting end fits within a counterbore on the outer bearing surface and is retained therein by means of a rivet or the like through the off-center hole. The valve assembly is prevented from rotating about the rivet by the sidewall of the counterbore to maintain proper orientation of the valve and retainer so that they precisely cover the discharge port.

4 Claims, 4 Drawing Sheets

METHOD OF INSTALLING A VALVE ASSEMBLY IN A COMPRESSOR

This is a division of application Ser. No. 311,108, filed Feb. 15, 1989, now U.S. Pat. No. 4,955,797.

BACKGROUND OF THE INVENTION

The present invention relates generally to compressors of the type having a cantilever mounted reed valve that controls the flow of refrigerant through a respective port communicating with the compression chamber of the compressor and, more particularly, to means for mounting the valve in a manner insuring proper indexing of the valve, i.e., orientation of the valve so as to precisely cover its associated port.

In general, positive displacement refrigeration compressors operate to compress refrigerant by drawing a substantially fixed volume of refrigerant through a suction port into a compression chamber, compressing the refrigerant by means of decreasing the volume of the compression chamber, and discharging the compressed refrigerant through a discharge port to a refrigeration system. In many compressor designs, particularly reciprocating piston compressors, the suction and discharge ports are simultaneously in communication with the compression chamber and, therefore, valving is required to insure proper flow of the refrigerant into and out of the compression chamber. Furthermore, discharge valves function to prevent reverse flow of refrigerant into the compression chamber when it is at a lower pressure than the refrigeration system.

One type of valving commonly employed in compressors of the type herein described is a cantilever mounted reed valve, wherein one end of the valve is attached to the compressor crankcase and the other end is positioned over a respective suction or discharge port. Consequently, the unattached end is free to open and close with respect to a valve seat surrounding the port opening. For proper seating of the valve onto the valve seat, it is essential that the valve be mounted in a manner to insure proper valve indexing, i.e., orientation of the unattached valve end precisely over the associated port. To this end, various and several methods of mounting reed valves have been utilized in prior art compressors.

Generally, prior art methods of cantilever mounting a reed valve in a compressor are designed to secure the mounted end of the valve against axial movement, and to prevent any rotational movement of the valve about the mounted end which would result in improper valve indexing. One common method of preventing rotation of the reed valve is to provide two spaced apertures in the mounting end of the valve, through which two corresponding locating pins or fasteners are received. For instance, where the mounting end of the valve is axially retained intermediate the top surface of the compressor crankcase and the bottom surface of a valve plate or cylinder head, a pair of locating pins are received through the spaced apertures. Likewise, when the reed valve is mounted directly onto the top surface of the valve plate, or onto the outer surface of the compressor crankcase or cylinder head in a hermetic compressor, the mounting end of the valve may be attached thereto by means of a pair of spaced rivets or screws. Accordingly, the head of the fastener axially retains the mounting end of the valve while spacing between fasteners properly indexes the opposite end of the valve over the valve seat.

One disadvantage associated with the aforementioned valve indexing method is the need to precisely locate and provide two locating pin holes or mounting holes for each valve. In most instances a single fastener will axially retain the mounting end of the valve, but the second fastener is required for valve indexing. Consequently, two locating pins or fasteners will also be required for each valve. Not only does the additional pin or fastener increase the manufacturing and materials cost of the compressor, but marginal costs are associated with the increased complexity and space requirements of such an arrangement.

Another prior art valve mounting arrangement provides a transverse cut or slot in the surface to which the valve is to be mounted. The slot is cut so as to define a boundary for the elongated reed valve, whereby the valve is properly indexed when situated in the slot. The mounting end of the valve may then be attached to the mounting surface by means of a single fastener, such as a screw or rivet. One disadvantage of this mounting method is the possibility that, during operation, the intermediate, unattached valve portion will contact the sidewall of the slot, thereby impeding free operation of the unattached end of the valve. Another disadvantage of this mounting method is the costs and limitations associated with providing the necessary indexing slot. Either a precision milling operation is required to machine the slot in a cast iron part, or a more expensive sintered or powdered iron material is required to cast the part with the slot already formed.

In a hermetic rotary compressor assembly to which the present invention is particularly applicable, an electric motor and compressor mechanism are located in a hermetically sealed housing. The electric motor is connected to a crankshaft which includes an eccentric portion located within a compression chamber bore defined by a compressor cylinder block. The crankshaft is journalled for rotation by a main bearing and an outboard bearing which define the axial ends of the compression chamber. A roller located within the compression chamber is mounted on the eccentric portion of the crankshaft and is driven thereby. The roller cooperates with a sliding vane to compress refrigerant within the chamber for discharge out respective discharge ports through the main and outboard bearings. A discharge valve assembly, comprising a reed valve and an overlying valve retainer, is mounted on the axially outer surface of the main and outboard bearing in operative association with a respective discharge port. In this arrangement, it is desired that the main and outboard bearings be of cast iron and that the valve assemblies be simply and inexpensively mounted to the bearings in a manner to insure proper indexing of the valves.

Accordingly, it is desired to provide cantilever mounting and proper indexing of a reed valve in a compressor, which overcomes the aforementioned problems and disadvantages of the prior art.

SUMMARY OF THE INVENTION

The present invention overcomes the problems and disadvantages of the above-described prior art valve assemblies, by providing an improved valve assembly and method for cantilever mounting the valve assembly such that an eccentric pivot point is provided for the mounting end of the valve, and a portion of the mounting surface prevents rotation of the valve about the pivot point, whereby the valve is properly oriented, or indexed, so that the free end of the valve precisely covers an associated flow port.

Generally, the present invention provides a mounting arrangement for a reed valve associated with a compressor assembly having a compression chamber within a crankcase and at least one port extending through said crankcase. A valve-supporting surface of the crankcase includes a well in which a substantially round mounting end portion of the reed valve is disposed. The valve is properly oriented such that an unattached end of the valve is operably positioned over a port from which fluid exits. The mounting end portion of the valve is retained in the well by means of a fastener attached to the crankcase and extending through an eccentrically located aperture in the mounting end. Any rotation of the valve about the pivot point established by the fastener is limited by engagement of the outer perimeter of the mounting end with the sidewall of the well, whereby the valve maintains proper orientation with respect to the flow port.

More specifically, in one aspect of the invention, the crankcase is cast iron and the well is a machined counterbore in the valve-supporting surface of the crankcase. The mounting end portion of the valve is generally round and has a diameter slightly less than the diameter of the counterbore, whereby when the mounting end portion is eccentrically fastened within the counterbore, only slight arc displacement of the free end of the valve is possible. In another aspect of the invention, a valve retainer shaped in like manner as the reed valve overlies the valve and is mounted in the same manner as the valve to insure proper orientation over the valve.

An advantage of the compressor valve assembly of the present invention is that reliable valve indexing is provided with reduced materials and manufacturing costs.

Another advantage of the compressor valve assembly of the present invention is that fewer parts are required than many prior art arrangements, thereby reducing the cost and complexity of the compressor.

Yet another advantage of the compressor valve assembly of the present invention, in one form thereof, is that valve indexing is provided that utilizes an easily machined counterbore, thus enabling the use of less expensive cast iron materials.

A further advantage of the compressor valve assembly of the present invention, in one form thereof, is that a rotary compressor having two axially outer bearing surfaces on which valve assemblies are mounted may provide mirror image valve assemblies utilizing the same component parts, thereby reducing the cost and complexity of the compressor.

An advantage of the method of mounting a valve assembly of the present invention, in one form thereof, is that a compressor having a properly indexed valve assembly may be constructed easily, inexpensively, and from a wide range of machineable materials, including cast iron.

The present invention provides, in one form thereof, a compressor assembly including a crankcase having a compression chamber therein. The compressor assembly also includes apparatus for compressing fluid within the compression chamber and at least one port in fluid communication with the compression chamber and extending through the crankcase. The port has an opening on a valve-supporting surface of the crankcase, wherein a portion of the surface surrounding the opening comprises a valve seat. A valve assembly for promoting fluid flow through the port in a direction exiting the opening includes a reed valve having a substantially round mounting end portion, an opposite free end portion configured to be capable of operably covering the valve seat, and an elongated intermediate portion extending generally along a central longitudinal axis of the valve. The compressor assembly also includes a substantially round well in the valve-supporting surface of the crankcase, which has a bottom surface and a side surface. The diameter of the mounting end portion is slightly less than the diameter of the well so as to enable the mounting end portion to be received within the well. The well is spaced from the opening a distance such that when the longitudinal axis of the valve is properly oriented, the free end portion of the valve is operably situated over the valve seat. Also provided is an indexing arrangement for properly orienting the mounting end portion of the valve within the well such that the free end portion is maintained operably situated over the valve seat. An eccentrically located aperture in the mounting end portion is provided through which is received a retainer pin member extending from the bottom surface of the well. In this manner, the valve is restrained from any significant rotation about the retainer pin member by engagement of the outer perimeter of the mounting end portion with the well sidewall, whereby proper orientation of the valve is maintained. In one aspect of the invention, the crankcase is cast iron and the well in the valve-supporting surface is a machined counterbore. In another aspect of the invention, the valve-supporting surface includes a recess having a bottom wall on which the opening and the valve seat are disposed, and a sidewall. The recess intersects the well to establish a passage therebetween, through which the valve extends such that the recess sidewall is spaced from the outer perimeter edge of the valve.

The invention further provides, in one form thereof, a method for installing a valve assembly on a valve-supporting surface of a compressor crankcase in a compressor assembly. The compressor assembly includes a crankcase, a compression chamber within the crankcase, apparatus for compressing fluid within the compression chamber, and at least one port in fluid communication with the compression chamber and extending through the crankcase. The port has an opening on the valve-supporting surface of the crankcase from which fluid flows, wherein a portion of the surface surrounding the opening comprises a valve seat. The method for installing the valve assembly includes a step of providing a reed valve having a substantially round mounting end portion, an opposite free end portion configured to be capable of operably covering the valve seat, and an elongated intermediate portion extending generally along a central longitudinal axis of the valve. A second step in the method is to form a substantially round well in the valve-supporting surface, which has a bottom surface and a side surface. The diameter of the mounting end portion is slightly less than the diameter of the well to enable placement of the mounting end portion within the well. The well is spaced from the opening a distance such that when the mounting end portion is placed within the well and the longitudinal axis of the valve is properly oriented, the free end portion of the valve is operably situated over the valve seat. A further step is to place the mounting end portion of the valve within the well such that the free end portion is operably situated over the valve seat. Next, there is established an eccentrically located pivot point for the mounting end portion with respect to the well bottom surface. In this manner, the valve is restrained from significant rotation about the pivot point by engagement of the outer perimeter of the mounting end portion with the well sidewall, whereby proper valve indexing is maintained. In one aspect of the invention, the crankcase is cast iron and the step of forming a well in the valve-supporting surface is performed by machining a counterbore in the cast iron crankcase.

DESCRIPTION OF THE PREFERRED EMBODIMENT

Figure 1:
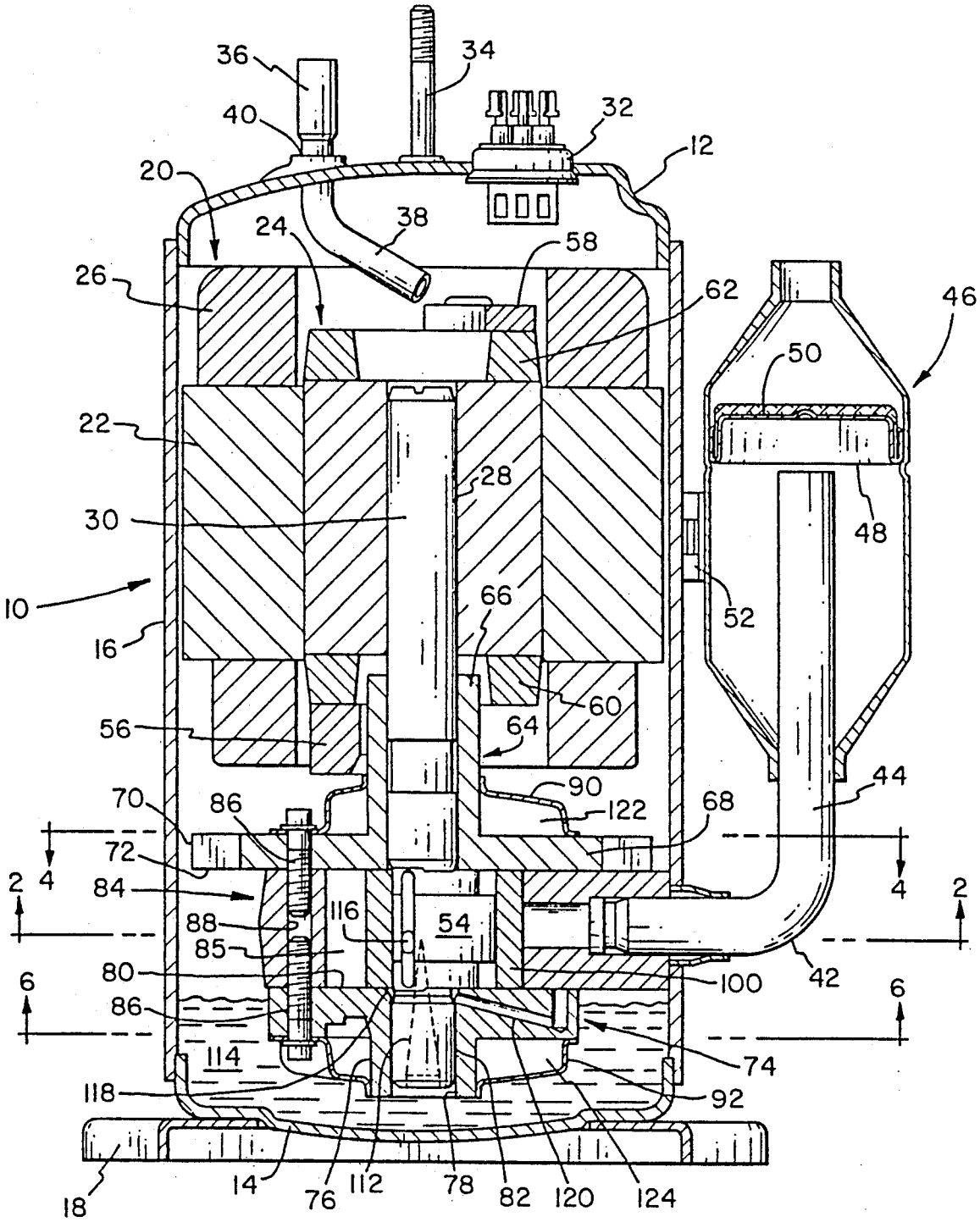
FIG. 1 is a side sectional view of an exemplary compressor to which the present invention is applicable.

In an exemplary embodiment of the invention as shown in the drawings, and in particular by referring to FIG. 1, a compressor is shown having a housing generally designated at 10. The housing has a top portion 12, a lower portion 14 and a central portion 16. The three housing portions are hermetically secured together as by welding or brazing. A flange 18 is welded to the bottom of housing 10 for mounting the compressor. Located inside the hermetically sealed housing is a motor generally designated at 20 having a stator 22 and a rotor 24. The stator is provided with windings 26. The stator is secured to the housing 10 by an interference fit such as by shrink fitting. The rotor 24 has a central aperture 28 provided therein into which is secured a crankshaft 30 by an interference fit. A terminal cluster 32 is provided on the top portion 12 of the compressor for connecting the compressor to a source of electric power. A post 34 is welded to top portion 12 for mounting a protective cover (not shown) for terminal cluster 32.

A refrigerant discharge tube 36 extends through top portion 12 of the housing and has an end 38 thereof extending into the interior of the compressor as shown. The tube is sealingly connected to housing 10 at 40 as by soldering. Similarly, a suction tube 42 extends into the interior of compressor housing 10 and is sealed thereto as by soldering, brazing, or welding. The outer end 44 of suction tube 42 is connected to accumulator 46 which has support plates 48 disposed therein for supporting a filtering mesh 50. A bracket 52 secures accumulator 46 to the outside wall of housing 10.

By referring specifically to FIG. 1, it can be seen that crankshaft 30 is provided with an eccentric portion 54 which revolves around the crankshaft axis as crankshaft 30 is rotatably driven by rotor 24. Counterweights 56 and 58 are provided to balance eccentric 54 and are secured to respective end rings 60 and 62 of rotor 24 by riveting. Crankshaft 30 is journalled in a main bearing 64 having a cylindrical journal portion 66 and a generally flat planar mounting portion 68. Planar portion 68 is secured to housing 10 at three points 70 such as by welding of flanges 72 to the housing, as best illustrated in FIG. 2.

A second bearing or journal 74, sometimes referred to as the outboard bearing, is also shown disposed in the lower part of housing 10. Outboard bearing 74 is provided with a journal portion 76 having aperture 78 therein and a generally planar portion 80. Crankshaft 30 has a lower portion 82 journalled in journal portion 76 of outboard bearing 74, as illustrated in FIG. 1.

Located intermediate main bearing 64 and outboard bearing 74 is a compressor cylinder block 84. Cylinder block 84 defines a cylinder therein, referred to herein as compression chamber 85. Compressor cylinder block 84, outboard bearing 74, and main bearing 64 are secured together by means of twelve bolts 86, two of which are indicated in FIG. 1. By referring to FIG. 2, it can be seen that six threaded holes 88 are provided in cylinder block 84 for securing bearings 64, 74 and cylinder block 84 together. Of the twelve bolts 86, six of them secure outboard bearing 74 to cylinder block 84 and are threaded into holes 88. The remaining six bolts secure main bearing 64 to cylinder block 84 and are also threaded into holes 88. An upper discharge muffler plate 90 is secured to main bearing 64 and a lower discharge muffler plate 92 is secured to outboard bearing 74 by bolts 86, as indicated in FIG. 1.

Figure 2:
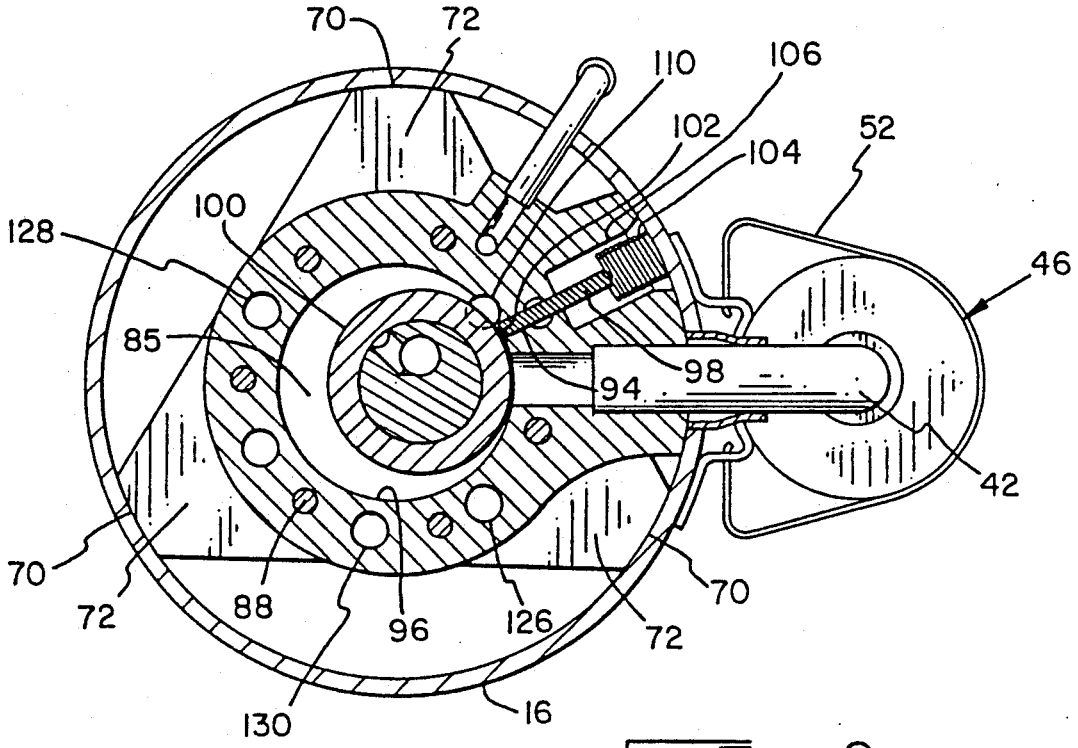
FIG. 2 is a sectional view of the compressor of FIG. 1 taken along the line 2—2 in FIG. 1 and viewed in the direction of the arrows.

By referring to FIGS. 1 and 2 it can be seen that cylinder block 84 has a vane slot 94 provided in the cylindrical sidewall 96 thereof into which is received a sliding vane 98. Roller 100 is provided which surrounds eccentric portion 54 of crankshaft 30 and revolves around the axis of crankshaft 30 and is driven by eccentric 54. Tip 102 of sliding vane 98 is in continuous engagement with roller 100 as vane 98 is urged against the roller by spring 104 received in spring pocket 106. Referring to FIG. 2, during operation, as roller 100 rolls around compression chamber 85, refrigerant will enter chamber 85 through suction tube 42. Next, the compression volume enclosed by roller 100, cylinder wall 96, and sliding vane 98 will decrease in size as roller 100 revolves clockwise around compression chamber 85. Refrigerant contained in that volume will therefore be compressed and after compression will exit through a relief 110 in sidewall 96.

The aforementioned compressor mechanism is presented by way of illustration only, it being contemplated that other piston means for compressing gas within chamber 85 may be used without departing from the spirit and scope of the present invention. As used herein, a compressor crankcase is defined as the necessary structure to define the compression chamber in which refrigerant is confined. For instance, in a reciprocating piston compressor, crankcase as used herein would encompass the cylinder head and any intermediate valve plate. In a rotary compressor, the crankcase as defined herein would include the cylinder block and axially disposed main and outboard bearings.

The rotary compressor disclosed herein provides a lubrication system for lubricating components of the compressor, including eccentric 54 and roller 100. Such a system is disclosed in U.S. Pat. No. 4,640,669, assigned to the same assignee as the present invention, the disclosure of which is hereby incorporated by reference. Referring to FIG. 1, components of an exemplary lubrication system are shown, including aperture 112 in crankshaft 30 into which oil is drawn from oil in oil sump 114. Aperture 112 delivers oil to opening 116 in crankshaft 30 to lubricate roller 100. Oil also flows into annular chamber 118 and radially outwardly therefrom through passageway 120, as described more fully in U.S. Pat. No. 4,640,669. A conventional oil paddle is axially mounted to end portion 82 of crankshaft 30 for contact with oil in oil sump 114.

Figure 4:
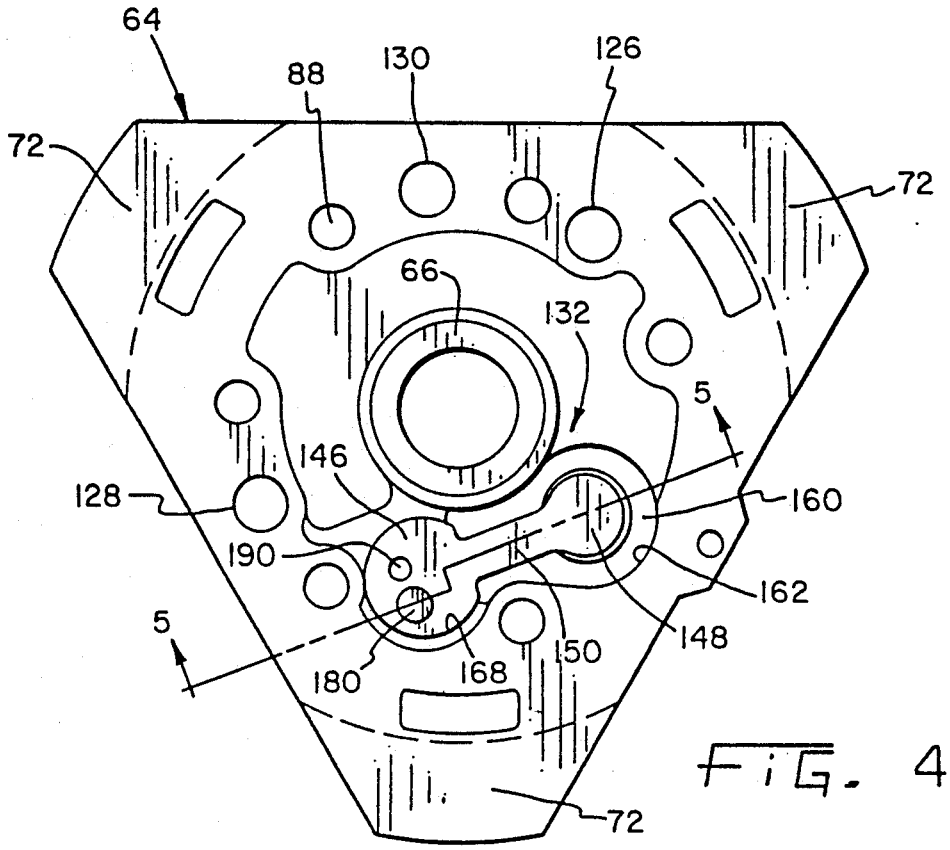
FIG. 4 is an enlarged top view of the main bearing of the compressor of FIG. 1, particularly showing a discharge valve assembly retained thereon.
Figure 6:
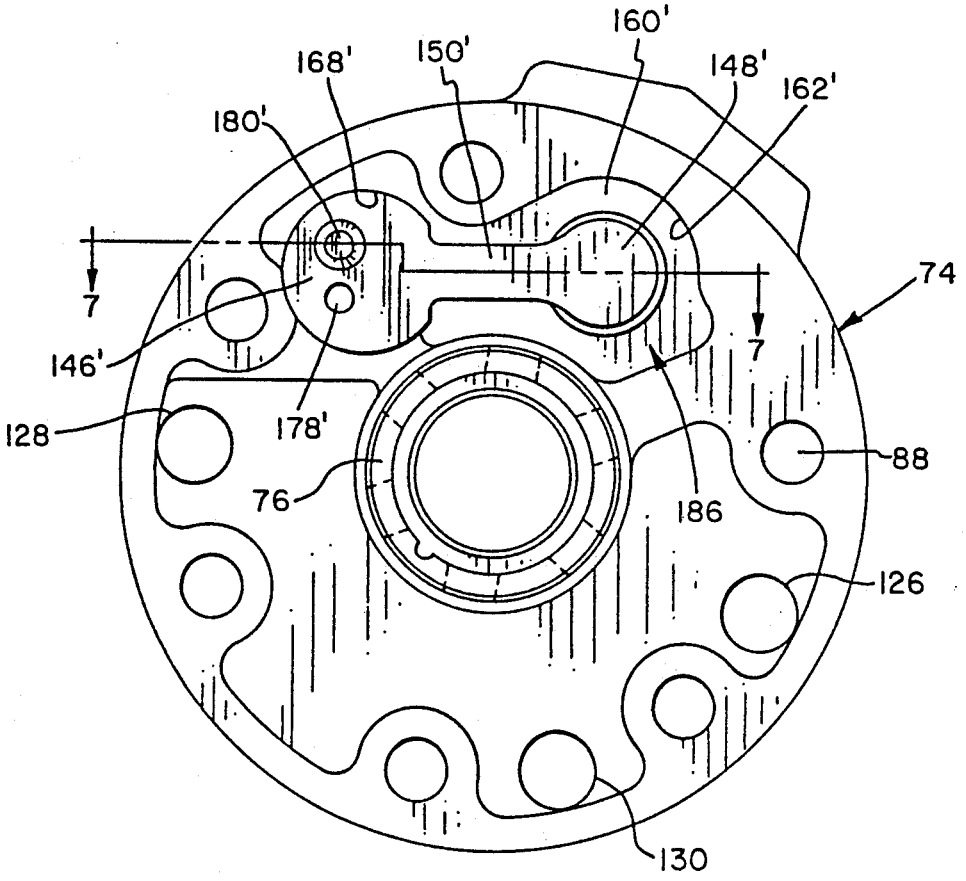
FIG. 6 is an enlarged bottom view of the outboard bearing of the compressor of FIG. 1, particularly showing a discharge valve assembly retained thereon.

The rotary compressor disclosed herein also provides a discharge muffler system, including an upper muffler chamber 122 defined by muffler plate 90, and a lower muffler chamber 124 defined by muffler plate 92. Compressed refrigerant is discharged axially outwardly from chamber 85 through ports in planar portions 68 and 80 into muffler chambers 122 and 124, respectively. A discharge valve assembly is associated with each port and is mounted to the axially outer surface of respective planar portions 68 and 80, as will be further described hereinafter. Referring to FIGS. 2, 4, and 6, a passageway 126 extends through cylinder block 84, main bearing 64, and outboard bearing 84 to provide fluid communication between muffler chambers 122 and 124, whereby the discharge gas is combined in lower muffler chamber 124. Likewise, a pair of passageways 128 and 130 provide fluid communication between lower muffler chamber 124 and the interior of the compressor housing.

Figure 3:
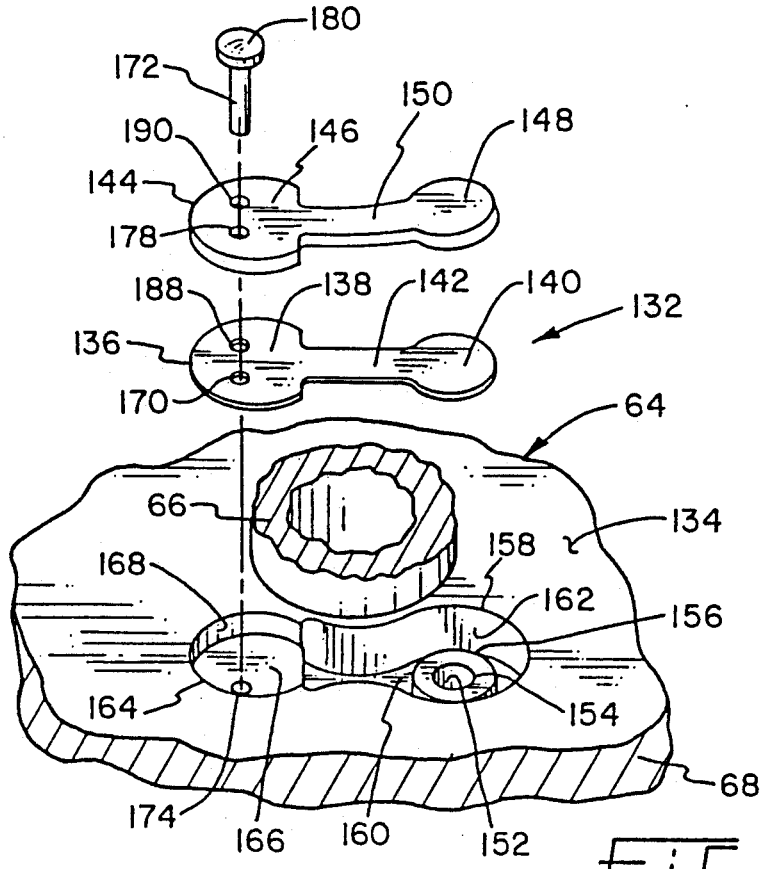
FIG. 3 is an enlarged fragmentary exploded perspective view of the main bearing and associated discharge valve assembly of the compressor of FIG. 1, in accordance with the principles of the present invention.
Figure 5:
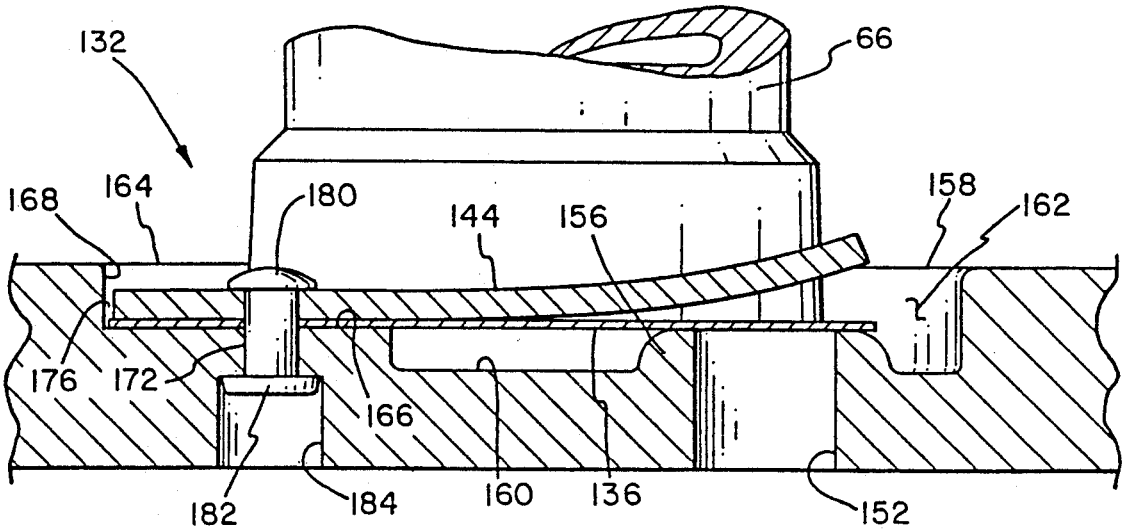
FIG. 5 is an enlarged fragmentary sectional view of the discharge valve assembly of FIG. 4 taken along the lines 5—5 in FIG. 4 and viewed in the direction of the arrows.

Referring now to FIGS. 3–5, there is shown an upper discharge valve assembly 132 mounted on an axially outer valve-supporting surface 134 of planar portion 68 of main bearing 64. As shown in FIG. 3, valve assembly 132 comprises a reed valve 136 including a round mounting end portion 138, a free end portion 140, and an elongated intermediate portion 142. As is conventional, a valve retainer 144 is provided which is like-shaped as valve 136, in this case having a mounting end portion 146, a free end retaining portion 148, and an elongated intermediate portion 150. According to a preferred embodiment, valve 136 is made of 0.012 inch thick bright polished Swedish flapper valve steel, and valve retainer 144 is made of 0.065–0.070 inch thick S.A.E. #1010 hot or cold rolled steel. Free end retaining portion 148 of retainer 144 is curved upwardly, as best shown in FIG. 5, to act as a stop to limit travel of free end 140 during valve operation.

As previously described, compressed refrigerant from compression chamber 85 is discharged through main and outboard bearings 64, 74. More specifically, main bearing 64 includes a discharge port 152 extending through planar portion 68 and forming an opening 154 on valve-supporting surface 134. A valve seat 156 is defined by the surface immediately surrounding opening 154 and, as disclosed herein, may comprise a raised annular portion. In the preferred embodiment as shown in the drawings, a recess 158 is provided in surface 134 into which valve seat 156 is disposed. Recess 158 includes a bottom wall 160 and a sidewall 162.

In accordance with the principles of the present invention, valve assembly 132 includes means for mounting valve 136 and valve retainer 144 to valve-supporting surface 134 in a manner to properly index or orient the valve and retainer so that respective free end portions 140 and 148 are operably oriented over valve seat 156. In one embodiment, it is desired that the arc displacement of the free end portion not exceed 0.020 inches during assembly and subsequent operation of the valve assembly. Accordingly, a round well 164 is formed in valve-supporting surface 134 in intersecting relationship with recess 158. Well 164 includes a bottom surface 166 and a side surface 168. Side surface 168 and recess sidewall 162 intersect along respective portions thereof to provide an opening or passageway through which valve 136 and retainer 144 may extend while remaining below the axially outermost portion of surface 134. In the disclosed embodiment, the depth of recess 158 relative to the outermost surface portion is greater than the depth of well 164; however, valve seat 156 is raised to depth substantially equal to that of well 164, as shown in FIG. 5.

Proper indexing of valve 136 is achieved in the following manner with respect to the referenced structure. Round mounting end portion 138 has a diameter slightly less than the diameter of round well 164, whereby mounting end 138 is received within well 164. The longitudinal axis of valve 136, extending along intermediate portion 142, is oriented in the direction of the coaxial center of hole 154 and valve seat 156. An eccentric aperture 170 in mounting end portion 138 receives a fastener 172 which is attached to planar portion 68 through an eccentric hole 174 in bottom surface 166. The eccentric locations of aperture 170 and hole 174 are the same with respect to the aligned centers of round mounting end portion 138 and round well 164. In the described arrangement, any tendency for valve 136 to rotate about the pivot point established by fastener 172 is resisted by the engagement of the outer perimeter of mounting end portion 138 with side surface 168 of well 164. It is noted that sidewall 162 is spaced from the perimeter edge of free end portion 140 and intermediate portion 142 to prevent interference therebetween during valve operation.

It will be appreciated that the degree of arc displacement of the free end of the valve in a given valve assembly according to the present invention is dependent upon several dimensions, including the length of the valve, the amount and angle of eccentricity of the aperture in the mounting end of the valve, and the difference between the diameter of the valve mounting end and the diameter of the well. In a preferred embodiment of the invention in accordance with the disclosed embodiment, the diameter of mounting end portion 138 is approximately 0.745 inches while the diameter of recess 164 is approximately 0.750 inches, thereby leaving an annular space 176 therebetween of approximately 0.0025 inches. Also, the distance between the center of mounting end portion 138 and the center of aperture 170 is approximately 0.164 inches, and the arc radius from the center of aperture 170 to the center of free end portion 140, i.e., the center of valve seat 156, is approximately 1.225 inches. It is also desirable to space aperture 170 a visually perceptible distance from the central longitudinal axis of valve 136 in order to distinguish an upper and lower surface of the valve for proper assembly.

The prior discussion regarding the indexing of valve 136 is equally applicable to the overlying valve retainer 144, wherein an aperture 178 aligned with corresponding aperture 170 is provided in mounting end portion 146. Both valve 136 and retainer 144 may be axially retained at their mounting end by means of a head portion 180 of fastener 172. Where fastener 172 is a rivet, as shown in the drawings, head portion 180 may be either the rivet head or its coined termination. In a preferred embodiment, as shown in FIG. 5, a head 182 of the rivet is received within a counterbore 184 on the axially inner surface of planar portion 168, and the opposite end is coined to form head portion 180 which retains the valve and retainer from axial movement. It will be appreciated that the valve assembly of the present invention does not depend upon any axial retaining force imparted by the fastener to provide valve indexing.

Figure 7:
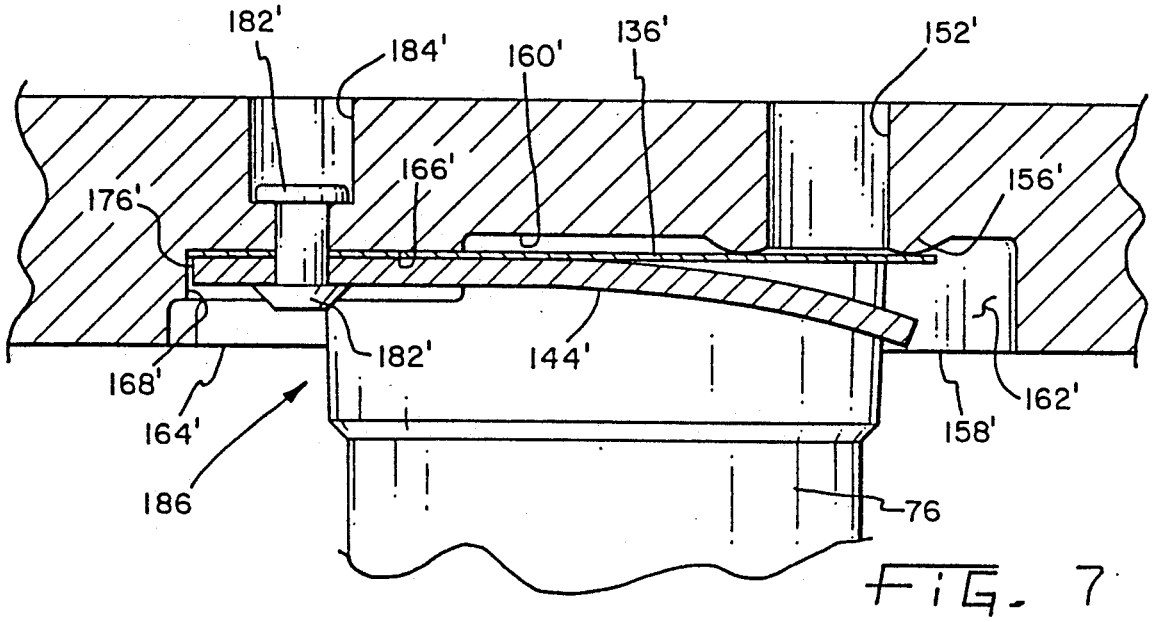
FIG. 7 is an enlarged fragmentary sectional view of the discharge valve assembly of FIG. 6 taken along the lines 7—7 in FIG. 6 and viewed in the direction of the arrows.

Referring now to FIGS. 6 and 7, there is shown a lower discharge valve assembly 186, which is a mirror image of upper valve assembly 132. The component parts and assembly thereof of valve assembly 186 is identical to valve assembly 132, with the exception of the provision of a second aperture 188 in valve 136 and a corresponding second aperture 190 in retainer 144, whereby the same valve and retainer may be employed in both the upper and lower valve assemblies 132, 186. More specifically, apertures 170 and 188 in valve 136 are bilaterally symmetric with respect to a central longitudinal axis of the valve, so that hole 174 may be located the same radial distance from the center of the respective journal portion of both the main and outboard bearings, thereby facilitating machining of the parts. Accordingly, apertures 170 and 178 for the valve and valve retainer are used for valve assembly 132, and apertures 188 and 190 are used for valve assembly 186. The above description regarding valve assembly 132 is equally applicable to valve assembly 186 as shown in FIGS. 6 and 7, with reference numerals of like parts being the same, only primed.

It will be appreciated that the same valve and retainer may also be employed in both the upper and lower valve assemblies 132, 186 by providing a single aperture in the respective round mounting end portion of each of the valve and retainer, which aperture is eccentrically located on the central longitudinal axis of the valve or retainer.

The method of the present invention has particular application to the disclosed compressor assembly wherein main bearing 64 and outboard bearing 74 are cast iron parts. After providing a reed valve 136 with round mounting end portion 138 and an eccentrically located aperture 170 therein, round recess 158 is formed in valve-supporting surface 134, into which mounting end 138 is received with free end portion 140 properly positioned over valve seat 156. An eccentrically located pivot point is established by the receipt of fastener 172 through aperture 178 and hole 174, whereby the valve is restrained from rotation about the fastener by the engagement of the outer perimeter edge of mounting end portion 138 with side surface 168 of well 164, as previously described. A primary advantage of the method of the present invention is that well 164 may be easily and inexpensively formed by machining a counterbore, rather than machining an elongated slot as required by prior art valve assemblies.

It will be appreciated that the foregoing is presented by way of illustration only, and not by way of any limitation, and that various alternatives and modifications may be made to the illustrated embodiment without departing from the spirit and scope of the invention.

What is claimed is:

1. A method for installing a valve assembly in a compressor assembly including a crankcase, a compression chamber within said crankcase, means for compressing fluid within said compression chamber, and at least one port in fluid communication with said compression chamber and extending through said crankcase, said port having an opening on a valve-supporting surface of said crankcase from which fluid flows wherein a portion of said surface surrounding said opening comprises a valve seat, wherein the valve assembly is installed on said crankcase surface, comprising the steps of:

providing a reed valve having a substantially round mounting end portion, an opposite free end portion configured to be capable of operably covering said valve seat, and an elongated intermediate portion extending generally along a central longitudinal axis of said valve;

forming a substantially round well in said valve supporting surface having a bottom surface and a side surface, the diameter of said mounting end portion being slightly less than the diameter of said well for placement of said mounting end portion within said well, said well being spaced from said opening a distance such that when said mounting end portion is placed within the well and the longitudinal axis of said valve is properly oriented said free end portion is operably situated over said valve seat;

placing said mounting end portion within said well such that said free end portion is operably situated over said valve seat; and establishing an eccentrically located pivot point for said mounting end portion with respect to said well bottom surface, whereby said valve is restrained from significant rotation about said pivot point by engagement of the outer perimeter of said mounting end portion with said well side surface, thereby maintaining proper orientation of said valve.

2. The method of installing a valve assembly of claim 1, wherein said crankcase is cast iron, in which:

said step of forming a well in said valve-supporting surface is performed by machining a counterbore in said cast iron crankcase.

3. The method of installing a valve assembly of claim 1 in which:

said step of establishing an eccentrically located pivot point is performed by providing an eccentrically located aperture in said mounting end portion of said valve and attaching said mounting end portion adjacent said well bottom surface by means of a fastener extending through said aperture and attaching to said crankcase.

4. The method of installing a valve assembly of claim 1, and further comprising the step of:

providing a recess in said valve-supporting surface having a bottom wall on which said opening and said valve seat are disposed and a sidewall, said recess intersecting with said well to establish a passage therebetween through which said valve extends from said mounting end portion disposed in said well to said free end portion disposed in said recess, said recess sidewall being spaced from the outer perimeter edge of said valve when said valve is properly oriented by said pivot point.

* * * * *